US007967228B2

(12) United States Patent
Hanghoj et al.

(10) Patent No.: US 7,967,228 B2
(45) Date of Patent: Jun. 28, 2011

(54) ROLLER MILL

(75) Inventors: Soren Hanghoj, Kopenhamn O (DK); Anders Fougner, Varlose (DK)

(73) Assignee: FLSMIDTH A/S (DK)

( * ) Notice: Subject to any disclaimer, the term of this patent is extended or adjusted under 35 U.S.C. 154(b) by 0 days.

(21) Appl. No.: 12/665,732

(22) PCT Filed: Apr. 28, 2008

(86) PCT No.: PCT/EP2008/055177

§ 371 (c)(1),
(2), (4) Date: Dec. 21, 2009

(87) PCT Pub. No.: WO2009/000577

PCT Pub. Date: Dec. 31, 2008

(65) Prior Publication Data

US 2010/0181404 A1 Jul. 22, 2010

(30) Foreign Application Priority Data

Jun. 27, 2007 (DK) ..... 2007 00927

(51) Int. Cl.
*B02C 15/00* (2006.01)

(52) U.S. Cl. ..... 241/121

(58) Field of Classification Search ..... 241/117–121
See application file for complete search history.

(56) References Cited

U.S. PATENT DOCUMENTS 4,168,807 A 9/1979 Dibowski et al.

OTHER PUBLICATIONS

International Search Report for PCT/EP2008/055177.
Written Opinion of the International Searching Authority for PCT/EP2008/055177.

*Primary Examiner* — Mark Rosenbaum
(74) *Attorney, Agent, or Firm* — Daniel DeJoseph; Aaron M. Pile

(57) ABSTRACT

Described is a roller mill (1) for grinding particulate material, such as cement raw materials, cement clinker and similar materials, said roller mill comprising a substantially horizontal grinding table (3), at least one therewith interactively operating roller (4) which is configured for rotation about a roller shaft (6) through the use of a bearing (7) for the roller, and a closed circulation system for lubricant for lubricating the bearing (7) for the roller, said circulation system comprising a reservoir (9), ducts (10) for feeding of lubricant to the bearing (7) for the roller and ducts (11) for recirculating the lubricant from the bearing (7) for the roller. The roller mill further comprises an autogenously regulated pressure pump means (20) which is driven by the rotation of the roller (4), and has a first part (21) which is mounted on the roller shaft (6) and a second part (22) which is mounted on the roller (4) and rotates therewith.

During the operation of the mill the pump means delivers a significant pressure contribution for recirculating the lubricant to the reservoir, and has a capacity which is proportional to the rotational speed of the roller and hence the lubricant requirement.

7 Claims, 4 Drawing Sheets

ROLLER MILL

CROSS-REFERENCE TO RELATED APPLICATIONS

This application is the United States national phase under 35 U.S.C.§371 of International Patent Application No. PCT/EP2008/055177, filed on Apr. 28, 2008 and claiming priority to Danish Patent Application No. PA200700927, filed on Jun. 27, 2007.

BACKGROUND OF THE INVENTION

1. Field of the Invention

Embodiments of the invention relate to a roller mill for grinding particulate material, such as cement raw materials, cement clinker and similar materials, said roller mill comprising a substantially horizontal grinding table, at least one roller that interactively operates with said grinding table, which is configured for rotation about a roller shaft through the use of a bearing for the roller, and a closed circulation system for lubricant for lubricating the bearing for the roller, said circulation system comprising a reservoir, ducts for feeding of lubricant to the bearing for the roller and ducts for recirculating the lubricant from the bearing for the roller.

2. Background of the Art

Roller mills of the aforementioned kind are well known, In the known roller mills lubricant is fed from the reservoir to the bearing for the roller through the use of a pressure pump, and after fulfilling its function in the bearing for the roller the lubricant is recirculated to the reservoir using a vacuum pump. The disadvantage of using a vacuum pump to recirculate the lubricant to the reservoir is that, quite often, its capacity is too small.

It is the objective of the present invention to provide a roller mill of the aforementioned kind where the aforementioned disadvantage is eliminated or significantly reduced.

BRIEF SUMMARY OF THE INVENTION

The above and other objects are obtained by a roller mill which further comprises a pump means which is driven by the rotation of the roller, said pump means having a first part which is mounted on the roller shaft and a second part which is mounted on the roller and rotates therewith.

Hereby is obtained an autogenously regulated pressure pump means which during the operation of the mill delivers a significant pressure contribution for recirculating the lubricant to the reservoir, and having a capacity which is proportional to the rotational speed of the roller and hence the lubricant requirement.

The pump means may be fitted at any location above the axial extension of the bearing for the roller or at one or both ends of the bearing for the roller. In order to maximize the capacity of the pump and to make it function as a pressure pump, it is preferred that it is fitted in exact axial position relative to the outer end of the bearing for the roller.

The pump means may be configured in any appropriate manner which will generate the capacity necessary to recirculate the lubricant to the reservoir. Hence, the pump means may in one embodiment be formed as a gear wheel pump which is fitted on the first part mounted on the roller shaft, and being driven by means of a gear rim which is fixed to the second part mounted on the roller. In this embodiment it is preferred that the first part mounted on the roller shaft comprises a number of ducts for feeding lubricant from the bearing for the roller to the gear wheel pump and a number of ducts for feeding lubricant from the gear wheel pump to the ducts for recirculating the lubricant to the reservoir.

In an alternative embodiment of the invention the pump means may be configured as a centrifugal pump, where the second part mounted on the roller on its inner side facing the first part is provided with force-transmitting means which transmit a force to the lubricant so that it is thrust in the direction from the central part of the second part towards its periphery, and where the first part mounted on the roller shaft comprises a number of ducts for feeding the lubricant from the bearing for the roller to the central part of the second part and a number of ducts for feeding the lubricant from the periphery of the second part to the ducts for recirculating the lubricant to the reservoir. The force-transmitting means may in principle be configured in any appropriate manner. In one embodiment, the force transmitting means may be provided by configuring the inner side of the second part with a certain roughness to ensure that the lubricant is made to rotate with the second part, thereby thrusting it towards the periphery. However, it is preferred that the force-transmitting means is formed as ribs or recesses extending from the central part of the second part to its periphery, and being either linear or curved.

DETAILED DESCRIPTION OF THE INVENTION

Figure 1:
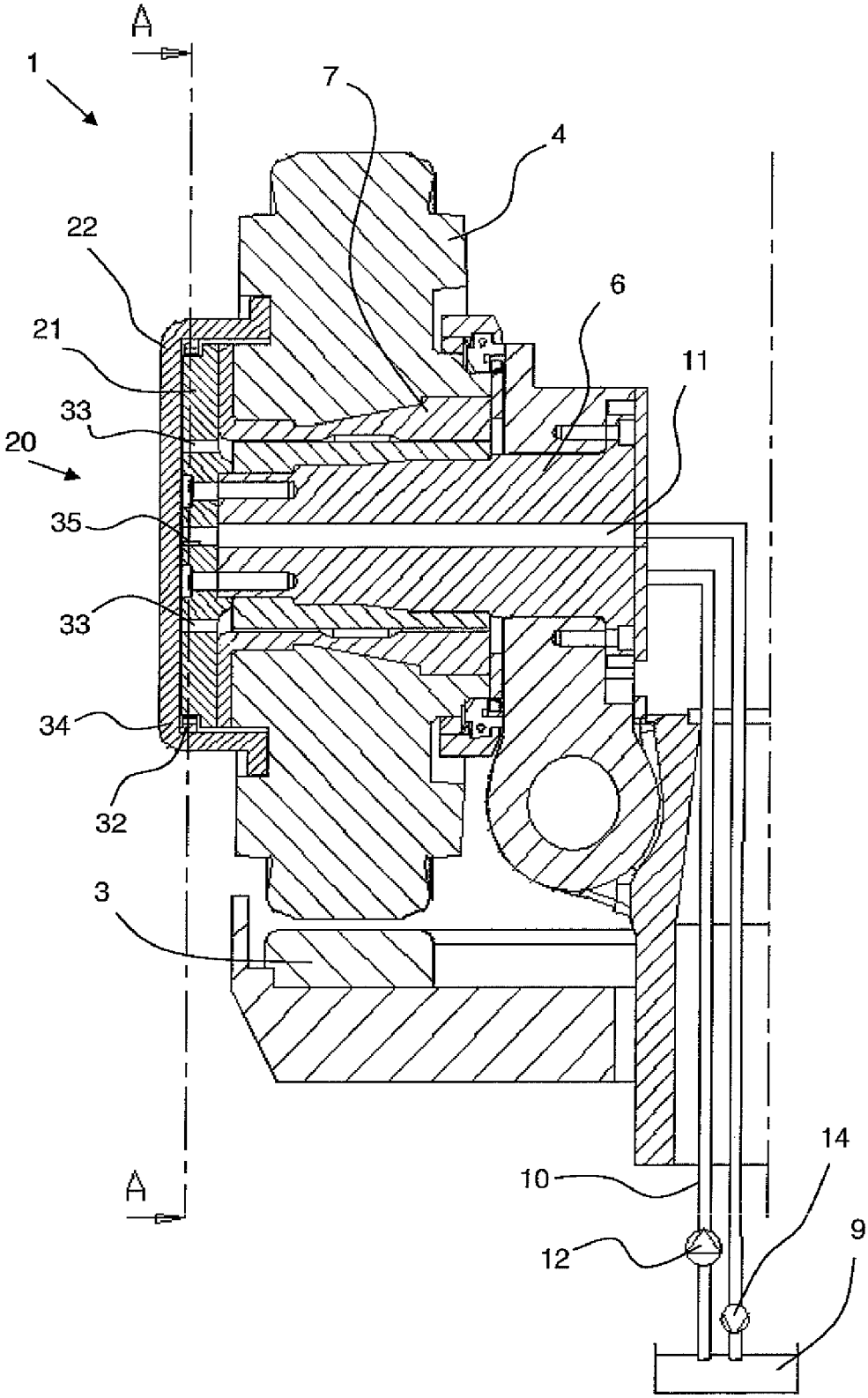
FIG. 1 shows a sectional view of an embodiment of the roller mill according to the invention.

In the FIGS. 1 to 4 where the same reference designations are used for the same elements, two embodiments are shown for a roller mill 1 according to the invention which comprises a horizontal grinding table 3 and a roller 4 operating interactively therewith. The roller 4 rotates about a roller shaft 6 by means of a bearing 7 for the roller 4 which in the shown embodiment is made up of a slide bearing. The bearing 7 per se is not a part of the present invention and may be differently configured, for example comprising at least two axially displaced roller bearings. The roller mill 1 further comprises a closed circulation system for lubricant for lubrication of the bearing 7 for the roller 4 during the operation of the roller mill, said circulation system comprising a reservoir 9 for lubricant, ducts 10 for feeding of lubricant to the bearing 7 and ducts 11 for recirculating the lubricant from the bearing 7. In the shown embodiments the lubricant is fed to the bearing 7 for the roller 4 by means of a pump 12. The roller mill 1 may further comprise a vacuum pump 14 for recirculating the lubricant to the reservoir 9.

According to the invention the roller mill comprises a pump means 20 which is driven by the rotation of the roller 4. The pump means 20 comprises a first part 21 which is firmly mounted on the roller shaft 6, and a second part 22 which is mounted on the roller 4, and rotating interactively with the latter. The pump means 20 will during the operation of the roller mill provide a significant pressure contribution for recirculating the lubricant to the reservoir 9.

In the embodiments shown, the pump means 20 is fitted in exact axial position relative to the outer end of the bearing 7, but in principle it may be fitted at any location over the axial extension of the bearing 7.

Figure 2:
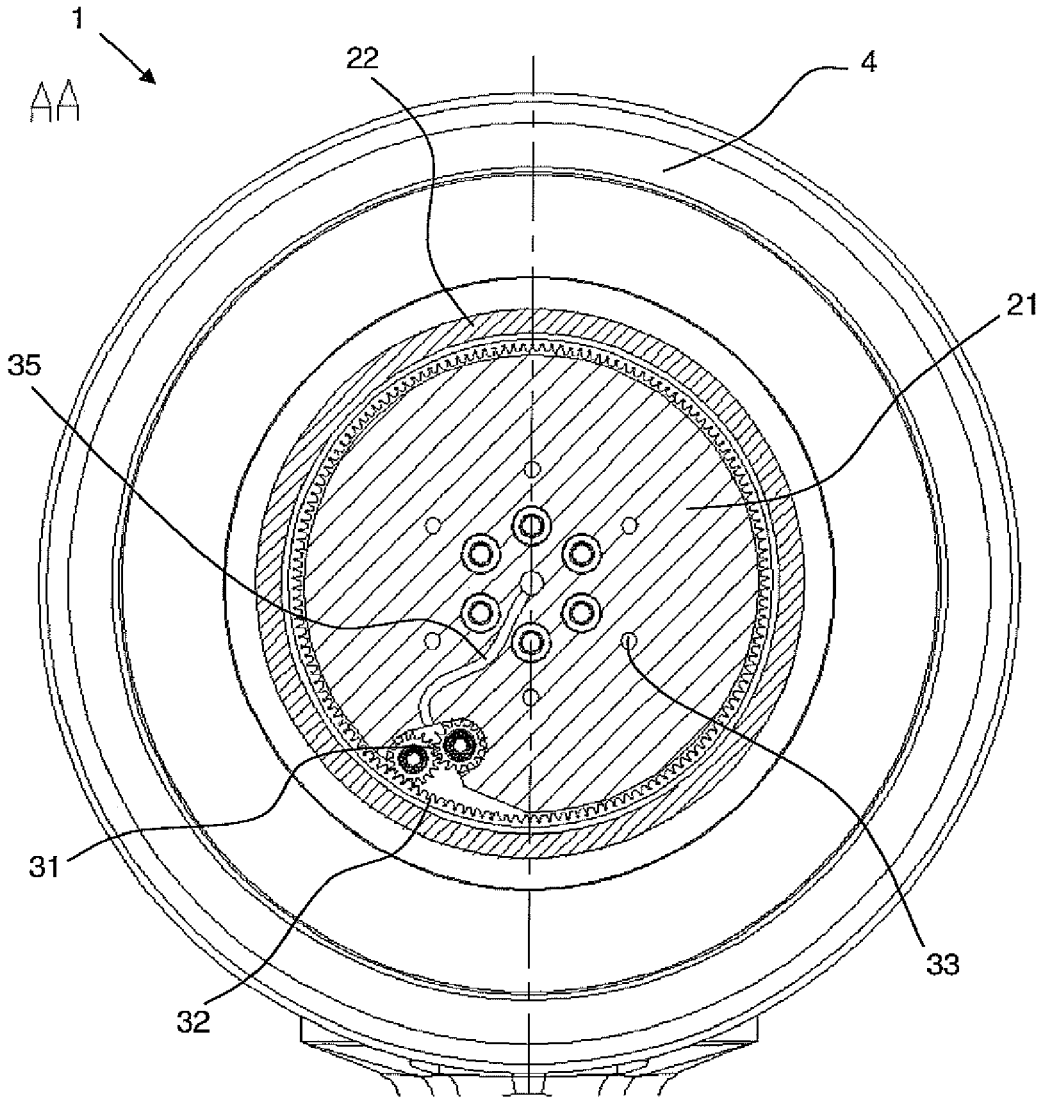
FIG. 2 shows a partial sectional view of a perspectival illustration of the roller mill shown in FIG. 1.

In the embodiment shown in the FIGS. 1 and 2 of the roller mill 1 the pump means 20 comprises a gear wheel pump 31 which is fitted to the first part 21 of the pump means 20, and a gear rim 32 which is fixed to the second part 22 of the pump means, and which drives the gear wheel pump 31. In this embodiment the lubricant is fed during the operation of the roller mill from the bearing 7 for the roller 4 to the gear wheel pump 31 via a plurality of ducts 33 which are arranged in the first part 21 of the pump means, and extending from the bearing 7 to an annular space 34 at the peripheral edge of the first part 21, said annular space 34 comprises the gear rim 32. During the operation of the roller mill, the gear rim 32 will draw the lubricant in the direction towards the gear wheel pump 31 which, when the pool of lubricant is at or above the height level of the gear wheel pump 31, will pump the lubricant via the duct 35 through to the duct 11 for recirculation of the lubricant to the reservoir 9.

Figure 3:
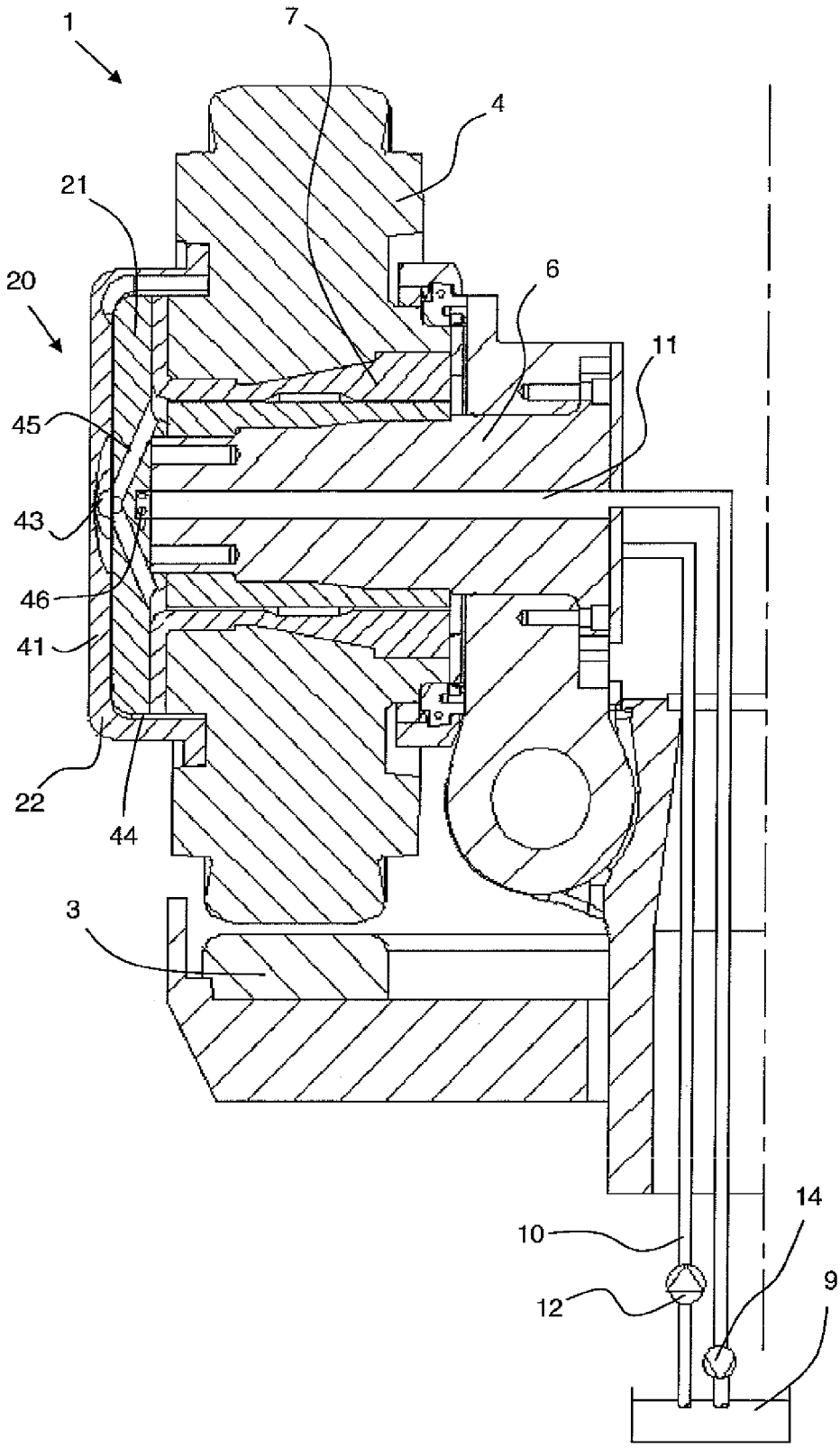
FIG. 3 shows a sectional view of an alternative embodiment of the roller mill according to the invention.
Figure 4:
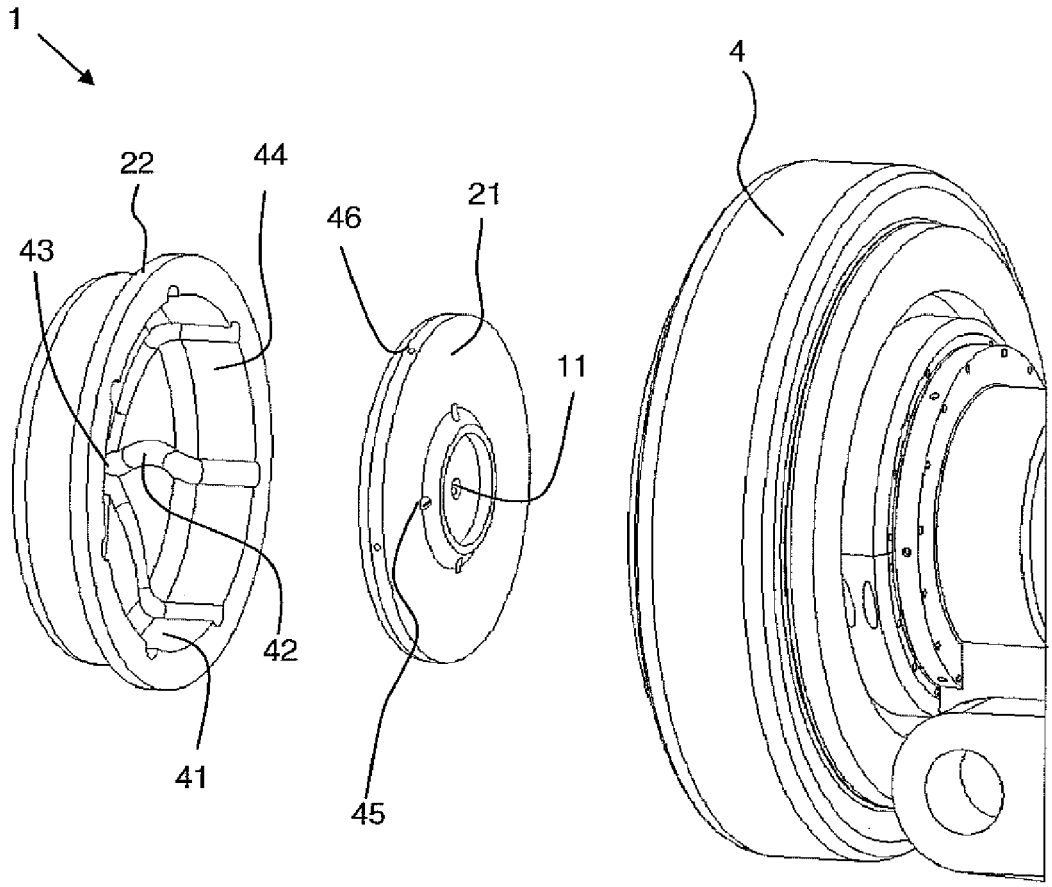
FIG. 4 shows an exploded, perspectival illustration of the roller mill shown in FIG. 3.

In the alternative embodiment of the roller mill 1 shown in FIGS. 3 and 4, the pump means 20 is configured as a centrifugal pump 41. In this embodiment the second part 22 mounted on the roller 4 is formed on its inner side facing towards the first part with some form of force-transmitting means 42 which imparts a force to the lubricant so as to thrust it in a direction from the central part 43 of the second part 22 towards its periphery 44, thereby generating a certain pressure in this last-mentioned area. In this embodiment, the force-transmitting means 42 is configured as curved recesses 42 in the second part 22, but may also be configured for example as projecting ribs or the like. During the operation of the roller mill, lubricant from the bearing 7 for the roller 4 is fed via at least one duct 45, which is provided in the first part 21, to the central part 43 of the second part 22, from which the lubricant, in response to the force imparted from the force-transmitting means 42, is thrust in direction towards the periphery of the second part 22. From here the lubricant is fed via at least one duct 46 to the duct 11 for recirculating the lubricant to the reservoir 9.

The invention claimed is:

1. A roller mill for grinding particulate material, comprising cement raw materials and cement clinker, said roller mill comprising:

a substantially horizontal grinding table, at least one roller that operates interactively with said table, said at least one roller configured for rotation about a roller shaft through the use of a bearing for the roller, said bearing having an outer end, and a closed circulation system for lubricant for lubricating the bearing, said circulation system comprising a reservoir, ducts for feeding of lubricant to the bearing, a duct for recirculating the lubricant from the bearing, a pump means which is driven by the rotation of the roller, said pump means comprising a first part which is mounted on the roller shaft and a second part which is mounted on the roller and rotates therewith.

2. The roller mill of claim 1, wherein the pump means is fitted in exact axial position relative to the outer end of the bearing.

3. The roller mill of claim 1, wherein the pump means comprises a first part that is mounted on the roller shaft, a second part mounted on the roller, a gear wheel pump fitted on the first part, and a gear rim fixed to the second part, said gear rim serving to drive the pump means.

4. The roller mill of claim 3, wherein the first part comprises a plurality of ducts for feeding lubricant from the bearing to the gear wheel pump and at least one duct for feeding lubricant from the gear wheel pump to the ducts for recirculating the lubricant to a reservoir for the lubricant.

5. The roller mill of claim 1, wherein the pump means is a centrifugal pump in which the second part is provided with force-transmitting means to transmit a force to the lubricant so that it is thrust in the direction from a central part of the second part towards its periphery, and where the first part comprises means for feeding lubricant from the bearing the second part and means for recirculating lubricant from the second part to the reservoir.

6. The roller mill of claim 5, wherein the force-transmitting means is formed as ribs or recesses extending from the central part to its periphery.

7. The roller mill of claim 6, wherein the force-transmitting means is either linear or curved.

* * * * *